United States Patent [19]

Walsh, Jr.

[11] 4,274,577

[45] Jun. 23, 1981

[54] EXPANSION FILING CONTAINER

[76] Inventor: Charles B. Walsh, Jr., 5 Tanglewood Cir., Wallingford, Pa. 19086

[21] Appl. No.: 39,516

[22] Filed: May 16, 1979

[51] Int. Cl.[3] ..... B65D 5/48

[52] U.S. Cl. ..... 229/1.5 R; 229/15; 229/DIG. 3

[58] Field of Search ..... 229/68 R, DIG. 3, 1.5 R, 229/41 R, 15

[56] References Cited

U.S. PATENT DOCUMENTS

| | | | |
|---|---|---|---|
| 975,792 | 11/1910 | Pittman | 229/68 R |
| 1,373,222 | 3/1921 | Bushnell, Jr. | 229/68 R |
| 1,622,753 | 3/1927 | Ahlquist | 229/68 R |
| 1,956,325 | 4/1934 | Hart | 229/68 R |
| 2,333,798 | 11/1943 | Kner | 229/68 R |
| 3,003,680 | 10/1961 | Wilcox, Jr. | 229/15 |
| 3,148,821 | 9/1964 | Gardiner | 229/15 |
| 3,648,923 | 3/1972 | Young | 229/DIG. 3 |

FOREIGN PATENT DOCUMENTS

| | | | |
|---|---|---|---|
| 42307 | 5/1930 | Denmark | 229/41 R |

*Primary Examiner*—Stephen P. Garbe

*Attorney, Agent, or Firm*—Benasutti Associates, Ltd.

[57] ABSTRACT

An expandable filing container which has a front panel, a back panel and an expandable connecting panel connecting the front and back panels. Hinged panels or flaps are positioned inside at each end of the container near the connecting panel. When the connecting panel is expanded to accommodate material in the container, the flaps are folded toward the connecting panel and are positioned between the front and back panels. A plurality of different degrees of expansion of the connecting panel, and flaps may be positioned at various locations inside the container to divide the container into compartments.

2 Claims, 4 Drawing Figures

EXPANSION FILING CONTAINER

BACKGROUND OF THE INVENTION

The present invention relates to filing products, and in particular relates to filing containers which have expandable sidewalls.

To provide a filing container with expandable or "gussetted" (as they are commonly referred to) sidewalls is well known in the art. The gussets allow the containers to expand easily and accommodate increasing volumes of material, but at the same, the flexible nature of the sidewalls permits the container to maintain a profile only as large as is necessary to accommodate the material there inside. There is, therefore, a corresponding saving in filing space, since the container in generally only slightly thicker than its contents.

These expandable file containers function well when small quantities of material are inserted therein, but as more and more material is inserted, the gussets are ultimately forced outward. This outward bulging quickly presents problems in inserting the container into file drawers, and moreover, important problems arise when these containers are stored in power files. The bulging sidewalls begin to interfere with the electric eye or other sensing mechanisms which control the devices since they cause the container to project further than its general dimensions.

At the present time, these types of file containers enjoy much commercial success, and this inconvenience of the "bulging gussets" must simply be coped with in light of the benefits attained.

SUMMARY OF THE INVENTION

With this problem in mind, it is a primary objective of the present invention to provide a gusseted or expandable filing container or product which does not bulge outwardly as material is inserted thereinto.

It is also an object of the present invention to provide an expandable filing container which can be easily and conveniently divided or sectioned into two or more compartments thereinside for separating the contents within the container.

And it is a further objective of this invention to provide a non-bulging expandable filing container wherein its collapsed size is not increased.

An expandable filing container is provided with at least one pair of flaps on the inside thereof at each end adjacent the expandable portion which connects the front and back panels of the container. When the container is substantially full and the expanded portion extended to its fullest, the flaps are hinged toward the expanded ends and are held between the front and back panels. The flaps reinforce the container and prevent the contents of the container from bulging the expandable ends outwardly. Flaps of various sizes may be provided when it is desired to prevent the ends from bulging, even though the expanded portion is not completely expanded, and the flaps, when not in use, are folded next to the front or back panels, thereby eliminating any appreciable increase in the dimensions of the collapsed container.

BRIEF DESCRIPTION OF THE DRAWINGS

Further objectives of the present invention along with a better understanding of the invention will be possible from the following detailed description of the invention taken in consideration with the formal drawings, wherein.

DETAILED DESCRIPTION OF THE INVENTION

Figure 1:
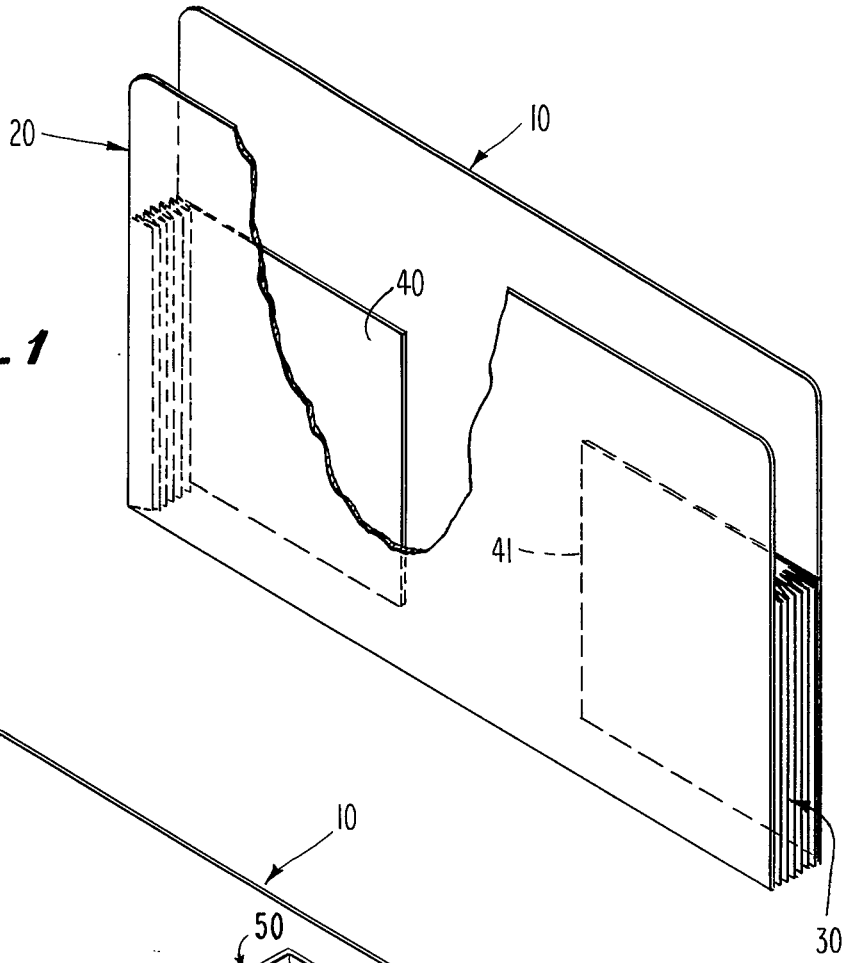
FIG. 1 is a perspective view of a filing container in the collapsed condition.

Although specific forms of the invention have been selected for illustration in the drawings, and the following description is drawn in specific terms for describing these forms of the invention, this description is not intended to limit the scope of the invention which is defined in the appended claims.

The structure of the filing container of the present invention incorporates many features which are found in the prior art. Usually, a back panel is connected to a front panel by means of an accordian-pleated connecting panel or gusset. These panels may be of one piece construction, but it is also possible for them to be of a laminated-type construction with two pieces or plys of paperboard material glued or otherwise attached to each other. In this latter construction, the connecting panel is securely affixed between the layers comprising each of the front and back panels. It is, of course, also recognized that the connecting panel may be affixed between the panels in other manners, such as simply by taping or gluing directly to the surfaces of the front and back panels. Furthermore, the connecting panel may be the same material as the front and rear panels, or it may be reinforced with cloth or other appropriate strengthening material.

As shown in FIG. 1, the present invention has a front panel 10 and a rear panel 20 connected by an accordian-pleated connecting panel 30 in the same manner as the prior art types of filing containers. The present filing container, however, differs from the prior art in that folding or hinged inside panels or flaps 40, 41 are provided on the inside of the container. When the filing container is open (FIG. 2), these inside flaps 40, 41 are hinged or opened in the direction of the connecting panel 30 at either end of the container. The flaps 40, 41 extend the connecting panel and prevent the contents of the container from pressing against the pleats of the connecting panel and prevent the pleats from bulging outwardly—as is likely to occur with the prior art containers without these flaps.

The flaps 40, 41 may be hinged from either the back panel 10 or the front panel 20 toward the connecting panel 30 at either end. It is also possible for one of the flaps at one end to be hinged from the back panel, while the flap at the opposite end is hinged from the front panel.

Since it is most important to provide and use these flaps when the filing container is full or substantially full, i.e., when the pleated connecting panel is fully extended, in the preferred embodiment of the invention, the flaps 40, 41 have substantially the same width as the width of the connecting panel when it is fully expanded, or at the most, the flaps are only slightly smaller (for example, ⅛" less) than the width of the expanded connecting panel. Because the flaps cause the connecting panel to be substantially taut in the fully expanded position and because of the positioning of the flap between the contents of the container and the pleats of the connecting panel, the connenting panel cannot bulge outward, and thus, maximum utility can be achieved from the filing container.

Figure 2:
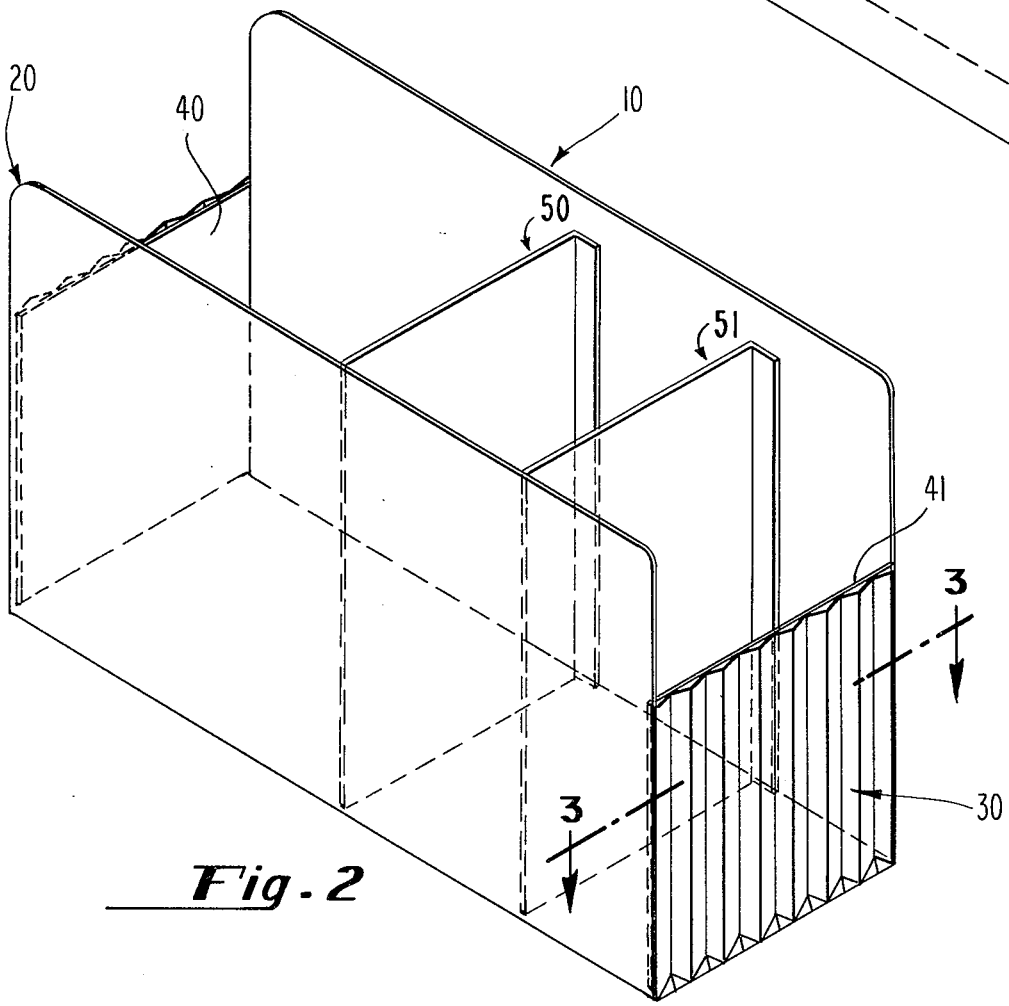
FIG. 2 is a perspective view of a filing container with interior flaps in the expanded position with the flaps folded outward.
Figure 3:
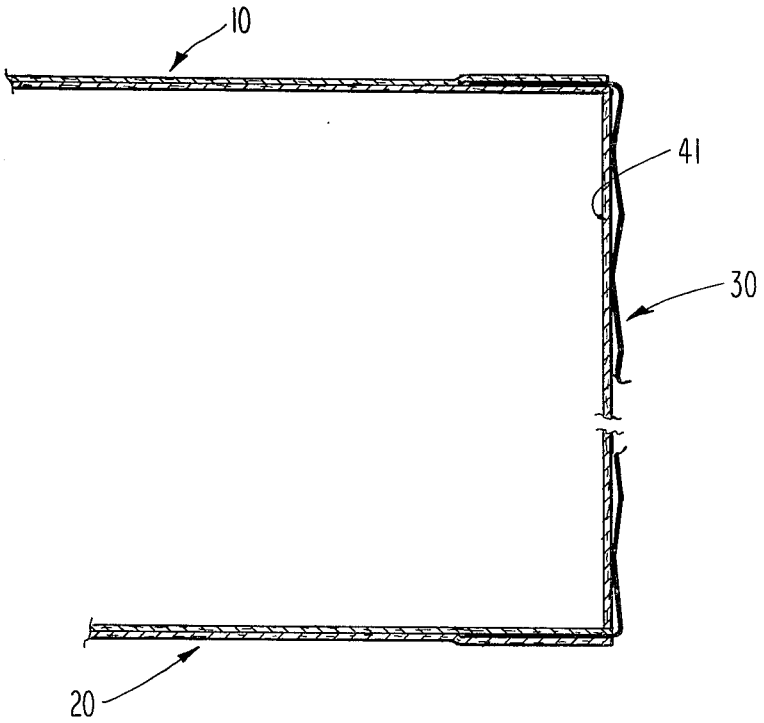
FIG. 3 is a top section view along the line 3—3 of FIG. 2 of one end of the container showing an integral flap in the open position.

As further shown in FIG. 2, the interior flaps 40, 41 have substantially the same height as the connecting panel 30 at each end of the folder. The connecting panel, however, does not necessarily have the same height as the front and back panels to which it is affixed, and while it is preferred that the inside flaps be substantially the same height as the connecting panel, it is also recognized that higher flaps may be provided. These higher flaps will add additional strength to the ends of the files. Furthermore, even interior flaps which are smaller in height than the height of the connecting panel will be of assistance in preventing the panel from bulging outwardly; however, the effectiveness is reduced and this structure is not recommended.

Figure 4:
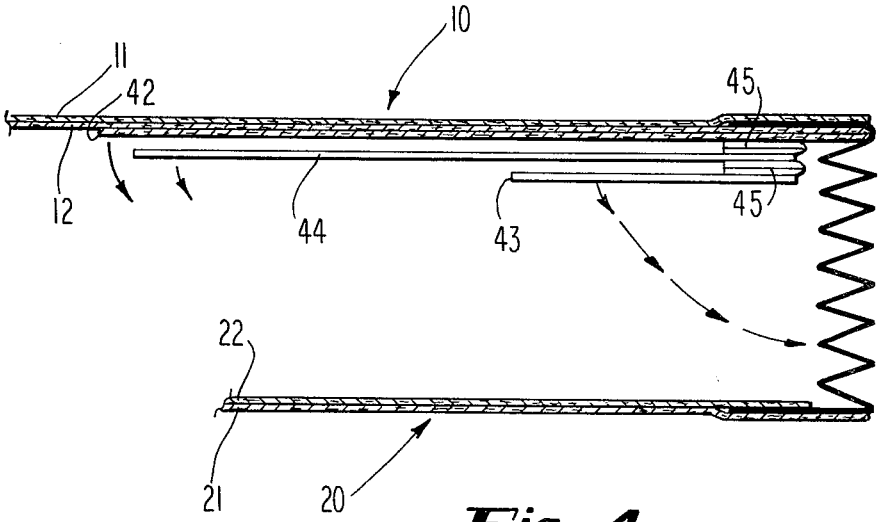
FIG. 4 is a top view of one end of a filing container which is partially expanded and wherein a plurality of flaps are provided.

The interior flaps 40, 41 have, up to this point, been described as having a width which is substantially the same as the expanded connecting panel 30—so that the completely filled container will not bulge outwardly at the ends. As is often the case, though, the file sometimes bulges outwardly when not full—simply due to the flexible nature of the pleated connecting panel. To overcome the bulging problem by folding the large flaps against a fully expanded connecting panel, however, produces a very wide container that demands considerable space for a small volume of material actually held therein. This problem can be overcome by providing a plurality of flaps on the inside of the container (FIG. 4). For example, the flaps which hinge from the back panel may be substantially the same width as the expanded panel, while the flaps which hinge from the front panel may have a smaller width (perhaps ½ of the width of the expanded connecting panel.) The same result can also be achieved by simply providing a plurality of pairs of flaps hinged either from the front or back panels, or both. These pairs of flaps having varying widths can be folded against the expanded connecting panel 30 in accordance with the amount of material within the container. In this manner, the container is only forced to be wide enough to hold the amount therein, while the ends are still prevented from bulging and filing space is kept at a minimum.

One embodiment of this construction utilizing a plurality of hinged flaps is shown in FIG. 4. Flaps 42, 43 and 44 are provided with hinges 45 to accommodate the addition of more material into the container. The flaps are arranged in increasing width toward the front or back panel from which they are hinged. When more material is inserted into the container, the next wider flap is hinged toward the expanded connecting panel.

One additional embodiment which will also permit the width of the container to vary while the ends are reinforced and expanded by the flaps is to provide a single wide flap at each end, but the flap is scored so that it may be easily folded to reduce its width according to the amount of material within the container. This construction of the flap may be especially useful when a smaller, constant amount of material is retained in the container; however, as more material is continuously added, the flap is somewhat weakened by the previous folds if it is unfolded to span across a wider expanse. When the amount of material in the container will fluctuate, the use of a plurality of flaps of increasing size is more efficient than using the flaps which may be folded to accommodate various widths.

Affixing the various different types of flaps or flap arrangements to the front or back panels can be achieved in several ways. The most obvious manner is to simply adhere the flaps either by glue, tape or some other suitable means to the respective panels near the connecting panel. In fact, this is an especially desirable technique when a plurality of flaps of various widths are being provided. A second technique is to form the flaps integrally with the front and/or back panels. As pointed out above, these panels are often of two-ply construction with the connecting panel affixed between the two plys 21, 22 and 11, 12. When the container is so formed, the flaps 41 or 42, for example, can be cut to extend integrally from one or both ends of the inside plys 12, 22 of the front and back panels. By providing the flaps in this manner, it is not necessary to affix the flaps 41 or 42 in a separate, independent step.

By providing the interior flaps of this invention at each end of the container adjacent the connecting panel, the strength of the container is increased and the ability of the connecting panel to withstand outward deformation is especially enhanced. Aside from these important contributions which the interior end flaps provide by way of increasing the durability of the container, interior flaps 50, 51 (FIG. 2) may also be provided along the length of either or both of the front and back panels in order to separate the interior of the container into a plurality of compartments. For example, variously spaced flaps 50, 51 along the back panel may be selectively hinged toward the front panel as necessary to provide divided areas for holding pens, pencils, envelopes, letters, etc. One or a plurality of these interior flaps may be provided and used independently or in combination as required to compartmentalize the interior of the container.

Although the description of the present invention is presented specifically in terms of applying these various interior flap configurations inside a type of an expandable filing container which is generally known as a file pocket, wherein the connecting panel is not as high as the front and back panel, it is also recognized that these flaps may be used in many other filing products wherein an expandable pleated panel is provided in order to increased the size of product. This includes, but is not limited to, file wallet or brief-type containers in which the back panel folds across the top of the container to prevent the contents from falling out and file jacket-type containers in which the expandable connecting panel is the same height as the front and back panels at each end.

Finally, the container and flaps of the present invention may be formed from many types of materials. Commonly used materials are kraft stock and red rope stock, and these may often be advantageously covered with cloth or various synthetic finishes, such as Tyvek (by DuPont), which will enhance the strength of the material. It is not, however, intended that the present invention should be specifically limited to these materials, and it will be understood that various changes in the details, materials and arrangements of the parts which have been herein described and illustrated in order to explain the nature of this invention may be made by those skilled in the art within the principle and scope of the invention as expressed in the following claims.

It will further be understood that the "Abstract of the Disclosure" set forth herein is intended to provide a non-legal technical statement of the contents of the disclosure in compliance with the Rules of Practice of the United States Patent and Trademark Office, and is not intended to limit the scope of the invention described and claimed herein.

What is claimed is:

1. An expandable container comprising:

(a) a back panel;

(b) a front panel;

(c) connecting means between said back and front panels for connecting said back and front panels, said connecting means being expandable and collapsible to vary the distance between said front and back panels; and (d) flap means comprising a plurality of pairs of foldable flap members of various widths hingedly connected to at least one of said front and back panels for spanning the distance between said front and back panels and adapted to open in sequence as said distance increases from fully closed to fully opened.

2. An expandable container comprising:

(a) a back panel;

(b) a front panel opposite said back panel;

(c) connecting means between said front and back panels for connecting said back and front panels, said connecting means being expandable and collapsable to vary the distance between said front and back panels; and (d) a plurality of pairs of flaps of varying sizes hingedly connected to at least one of said front and back panels, said flaps being arranged in increasing width and adapted to open in sequence so that as more material is inserted into the file, the next wider flap starting from the narrowest of said flaps can be hinged towards the expanded connecting panel.

* * * * *